United States Patent [19]

Martin et al.

[11] Patent Number: 4,496,933

[45] Date of Patent: Jan. 29, 1985

[54] COOLED RESISTOR PACK FOR BRUSH WITH INDIVIDUALLY INSULATED STRANDS

[75] Inventors: Donald G. Martin, Penn Township, Allegheny County; Donald M. York, Gibsonia, both of Pa.

[73] Assignee: Westinghouse Electric Corp., Pittsburgh, Pa.

[21] Appl. No.: 584,173

[22] Filed: Feb. 27, 1984

[51] Int. Cl.[3] ..... H01C 1/82

[52] U.S. Cl. ..... 338/55; 338/295; 310/72

[58] Field of Search ..... 338/55, 57, 295, 273, 338/256, 254, 252, 230; 310/72, 71, 239, 249

[56] References Cited

U.S. PATENT DOCUMENTS

| | | | |
|---|---|---|---|
| 2,384,025 | 9/1945 | Graham | 338/55 |
| 2,491,193 | 12/1949 | Matthews | 338/295 |
| 3,858,149 | 12/1974 | Kirilloff | 338/57 X |
| 3,980,910 | 9/1976 | Steinebronn et al. | 310/71 |
| 4,337,407 | 6/1982 | Hummert | 310/248 |

*Primary Examiner*—Roy N. Envall, Jr.
*Assistant Examiner*—C. N. Sears
*Attorney, Agent, or Firm*—F. J. Baehr, Jr.

[57] ABSTRACT

A cooled resistor pack for a dynamoelectric machine wherein cooling water is passed through ducts in a conductive block and plurality of connectors are mechanically attached to the conductive block but electrically insulated therefrom and nichrome wires of varying length and varying in number electrically join the connectors to the conductive block and individually insulated brush segments, which have individual strands and the brush segments are connected to separate connectors in such a manner that the resistance between the brush segments and the block decreases from the trailing end segments to the leading end segments of the brush.

8 Claims, 1 Drawing Figure

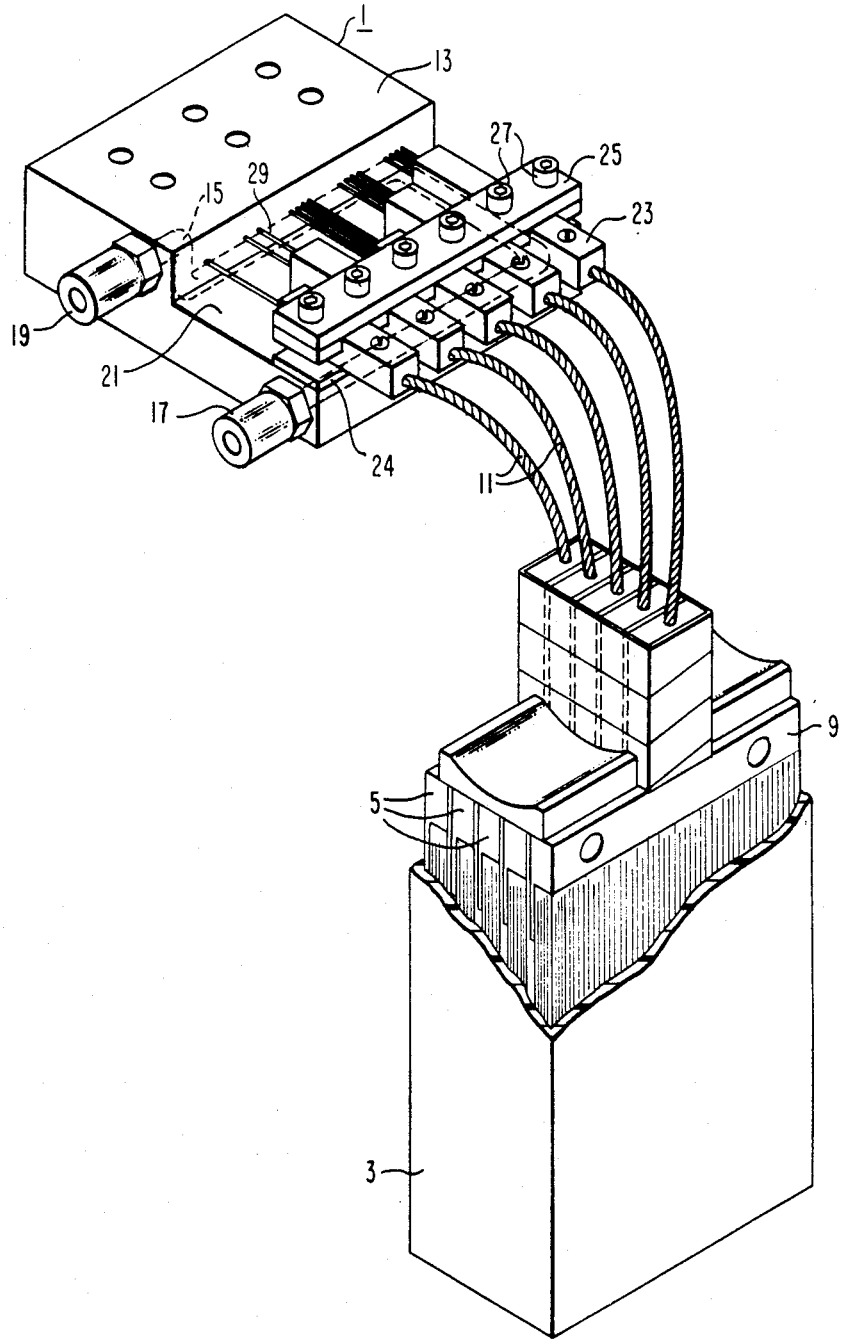
1
13
27
25
29
15
23
19
21
17
24
11
9
5
3

COOLED RESISTOR PACK FOR BRUSH WITH INDIVIDUALLY INSULATED STRANDS

BACKGROUND OF THE INVENTION

This invention relates to brushes for dynamoelectric machinery and more particularly to a cooled resistor pack for a brush made up of a plurality of individual conductive strands. The description of such a brush and the need for connecting the brush to a machine through series resistors is described in U.S. Pat. No. 4,337,407, which is hereby incorporated by reference. In this patent the resistance is shown adjacent the brush and no cooling is indicated.

SUMMARY OF THE INVENTION

In general, a cooled resistor pack for a brush having a plurality of multi-strand segments, wherein the segments are insulated from each other, when made in accordance with this invention, comprises a conductive block having ducts cooperatively associated with the block to remove heat from the block, a plurality of conductors mechanically fastened to the block and electrically insulated from the block, wires having high resistivity electrically connecting the connectors to the block and a highly conductive lead electrically connecting each of the brush segments to a separate connector.

BRIEF DESCRIPTION OF THE DRAWINGS

The objects and advantages of this invention will become more apparent from reading the following detailed description in conjunction with the accompanying drawing, in which:

The sole FIGURE is a perspective view of a brush connected to a cooled resistor pack made in accordance with this invention.

DESCRIPTION OF THE PREFERRED EMBODIMENT

Referring now to the sole FIGURE in detail, there is shown a cooled resistor pack 1 electrically connected to a brush 3. The brush 3 is made up of a plurality of brush segments 5 electrically insulated from each other and each segment 5 has a plurality of individual fibers which are electrically connected to a T-shaped bar 9 or other conductor. Extending from the T-shaped bar 9 are leads or pigtails 11.

The cooled resistor pack 1 comprises a conductive block 13, which is preferably made of a high conductive material, such as copper, and is electrically connected to the stator of a dynamoelectric machine such as a Segmag machine. The conductive block 13 has cooling ducts 15 in which water or other cooling fluid passes to cool the block 13. Inlet and outlet couplings 17 and 19, respectively, are connected to cooling water conduits (not shown). The block 13 has a step 21 on one side thereof and connectors 23 made of copper or other highly conductive material are disposed between insulating strips 24 and 25, made of micarta or other insulating material, which are fastened to the lower tred of the step by cap screws 27 or other fasteners in such a manner that the connectors 23 are electrically insulated from the block 13. The connectors 23 vary in length but have one end disposed generally the same distance from the riser of the step. The other end of the connectors 23 are disposed a varying distance from the riser. Varying numbers of resistive wires 29 made of Nichrome alloy or other highly resistive material extend from tightly fitting holes in the connectors 23 to tightly fitting holes in the riser of the step in the block 13 to electrically connect the connectors 23 to the block 13 in such a manner that the varying degrees of resistance is imposed between the connectors 23 and the block 13. The resistance can be varied not only by varying the length of the nichrome wire 29, but also by varying the number and/or size of the wires 29 between each connector 23 and the block 13. Therefore, generally any quantity of resistance can be interposed between the connectors 23 and the block 13 and this quantity of resistance can be easily changed.

The pigtail 11 attached to each segment of the brush 3 is electrically and mechanically connected to a separate connector 23 in such a manner to provide decreasing resistance from the trailing segments of the brush to the leading segment.

The cooled resistor pack 1 advantageously provides cooling to heat dissipation area adjacent the nichrome wire 29 without harm to the brushes 3, mechanical support to these resistive elements 29, greater design flexibility by allowing resistance values to be changed without changing the brushes 3, the standard brush segments 5 or the pigtails 11.

What is claimed is:

1. The combination of a cooled resistor pack and brushes having a plurality of multi-strand segments insulated from each other, said combination comprising:

a conductive block having ducts cooperatively associated therewith to remove heat therefrom;

a plurality of connectors mechanically fastened to said block and electrically insulated therefrom;

wires having high resistivity electrically connecting said conductors to said block; and a highly conductive lead electrically connecting each of the brush segments to a separate connector.

2. The combination as set forth in claim 1, wherein the highly conductive leads are generally the same length.

3. The combination as set forth in claim 1, wherein the connectors vary in length.

4. The combination as set forth in claim 1, wherein the number of highly resistive wires electrically connecting the connectors and the block varies.

5. The combination as set forth in claim 3, wherein the length of the highly resistive wires electrically connecting the block connectors varies in length.

6. The combination as set forth in claim 5, wherein the distance from one end of each connector to the block is generally constant.

7. The combination as set forth in claim 6, wherein the resistance of the highly resistive wires electrically connected to the leading segment of the brush is substantially less than the resistance of the highly conductive resistive wires electrically connecting the trailing segment of the brush to the block.

8. The combination as set forth in claim 5, wherein the number of highly resistive wires electrically connecting the conductors and the block varies.

* * * * *